US005167546A

United States Patent [19]

Whipple

[11] Patent Number: 5,167,546

[45] Date of Patent: Dec. 1, 1992

[54] AUTOMATIC TRIM SYSTEM

[75] Inventor: Roger B. Whipple, Grayslake, Ill.

[73] Assignee: Outboard Marine Corporation, Waukegan, Ill.

[21] Appl. No.: 744,952

[22] Filed: Aug. 14, 1991

[51] Int. Cl.[5] ..... B63H 5/12

[52] U.S. Cl. ..... 440/1; 440/61

[58] Field of Search ..... 440/1, 2, 53, 61

[56] References Cited

U.S. PATENT DOCUMENTS

| | | | |
|---|---|---|---|
| 4,352,666 | 10/1982 | McGowan | 440/53 |
| 4,710,141 | 12/1987 | Ferguson | 440/61 |
| 4,718,872 | 1/1988 | Olson et al. | 440/1 |
| 4,759,732 | 7/1988 | Atsumi | 440/1 |
| 4,762,079 | 8/1988 | Takeuchi et al. | 114/152 |
| 4,786,263 | 11/1988 | Burmeister et al. | 440/53 |
| 4,787,867 | 11/1988 | Takeuchi et al. | 440/1 |
| 4,822,307 | 4/1989 | Kanno | 440/1 |
| 4,908,766 | 3/1990 | Takeuchi | 364/448 |
| 4,931,025 | 6/1990 | Torigai et al. | 440/1 |
| 4,939,660 | 7/1990 | Newman et al. | 364/442 |

*Primary Examiner*—Sherman D. Basinger

*Attorney, Agent, or Firm*—Michael, Best & Friedrich

[57] ABSTRACT

A marine propulsion device comprising a propulsion unit adapted to be mounted to a boat for pivotal movement about a generally horizontal tilt axis, and for pivotal movement about a generally vertical steering axis, the propulsion unit including a propeller shaft adapted to support a propeller for rotation therewith, the marine propulsion device further comprising a steering mechanism for pivoting the propulsion unit about the steering axis, and a control system including structure for sensing force applied on the steering mechanism by the propulsion unit, and structure for pivoting the propulsion unit about the tilt axis in response to the force sensed by the force sensing structure.

20 Claims, 3 Drawing Sheets

AUTOMATIC TRIM SYSTEM

BACKGROUND OF THE INVENTION

The invention relates generally to marine propulsion devices such as outboard motors and stern drive units. More particularly, the invention relates to systems for counterbalancing the torque or force exerted on a marine propulsion device steering mechanism by the propulsion unit as a result of rotation of the propeller in water.

Previously proposed systems for counterbalancing steering torque typically involve the use of trim tabs. See, for example, McGowan U.S. Pat. No. 4,352,666, which is incorporated herein by reference. See also Atsumi U.S. Pat. No. 4,759,732, Takeuchi et al. U.S. Pat. No. 4,787,867, and Takeuchi U.S. Pat. No. 4,908,766.

SUMMARY OF THE INVENTION

The invention provides a marine propulsion device comprising a propulsion unit adapted to be mounted to a boat for pivotal movement about a generally horizontal tilt axis, and for pivotal movement about a generally vertical steering axis, the propulsion unit including a propeller shaft adapted to support a propeller for rotation therewith, the marine propulsion device further comprising a steering mechanism for pivoting the propulsion unit about the steering axis, and a control system including means for sensing force applied on the steering mechanism by the propulsion unit, and means for pivoting the propulsion unit about the tilt axis in response to the force sensed by the force sensing means.

One embodiment of the invention provides a method of monitoring force on a steering mechanism of a marine propulsion device including a propulsion unit adapted to be mounted on the transom of a boat for pivotal movement about a generally horizontal tilt axis and for pivotal movement about a generally vertical steering axis, the steering mechanism effecting pivotal movement of the propulsion unit about the generally vertical steering axis, the method comprising the steps of measuring the force applied to the steering mechanism by the propulsion unit, and pivoting the propulsion unit about the tilt axis in response to the measured force.

One embodiment of the invention provides a method of monitoring force on a steering mechanism of a marine propulsion device including a propulsion unit adapted to be mounted on the transom of a boat for pivotal movement about a generally horizontal tilt axis and for pivotal movement about a generally vertical steering axis, the steering mechanism effecting pivotal movement of the propulsion unit about the generally vertical steering axis, the method comprising the following steps: (a) providing a counter, and means for generating an activation signal; (b) initializing the counter only in response to the activation signal, then proceeding to step (c) after initializing the counter; (c) measuring the force applied to the steering mechanism by the propulsion unit, then proceeding to step (d); (d) determining if the force measured in step (c) is greater than a predetermined acceptable force value, and if so, proceeding to step (e), and if not, proceeding to step (b); (e) incrementing the counter, then proceeding to step (f); (f) determining if the counter is in excess of a predetermined value, and if so, proceeding to step (b), and if not, proceeding to step (g); (g) causing the propulsion unit to pivot about the tilt axis in a first angular direction for a predetermined amount of time, then proceeding to step (h); (h) waiting for a predetermined amount of time, then proceeding to step (i); (i) measuring the force applied to the steering mechanism by the propulsion unit, then proceeding to step (j); (j) determining if the force measured in step (i) is less than the force measured in step (c), and if so, proceeding to step (k), and if not, proceeding to step (1); (k) determining if the force measured in step (i) is greater than the predetermined acceptable force value, and if so, proceeding to step (e), and if not, proceeding to step (b); (1) incrementing the counter, then proceeding to step (m); (m) determining if the counter is in excess of the predetermined value, and if so, proceeding to step (b), and if not, proceeding to step (n); (n) causing the propulsion unit to pivot about the tilt axis in second angular direction opposite to the first angular direction and for a predetermined amount of time, then proceeding to step (o); (o) waiting for a predetermined amount of time before proceeding to step (p); (p) measuring the force applied to the steering mechanism; (q) determining if the force measured in step (p) is greater than the force measured in step (c), and if so, proceeding to step (e), and if not, proceeding to step (r); (r) determining if the force measured in step (p) is greater than the predetermined acceptable force value, and if so, proceeding to step (1), and if not, proceeding to step (b).

Other features and advantages of the invention will become apparent to those of ordinary skill in the art upon review of the following detailed description, claims, and drawings.

Figure 1:
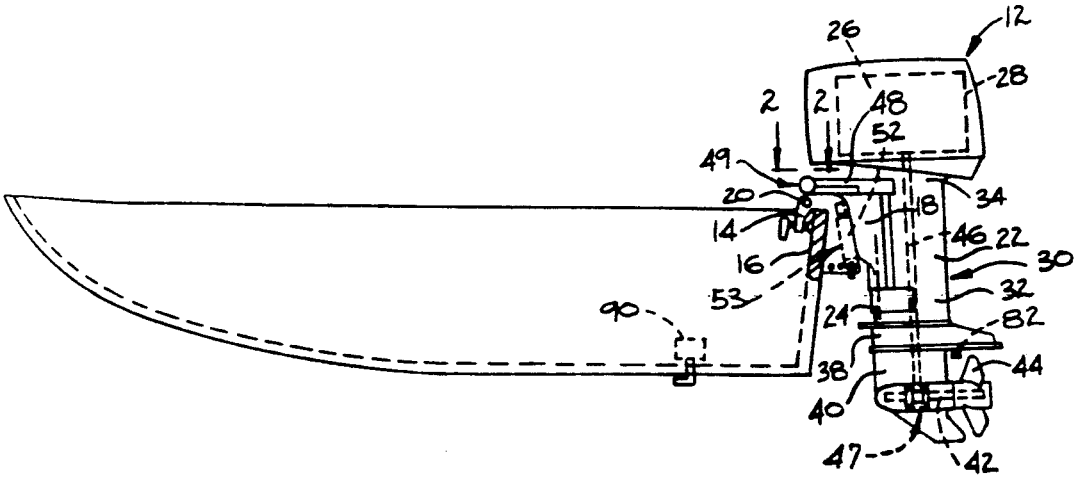
FIG. 1 is a side elevational view of a marine propulsion device which embodies various of the features of the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DETAILED DESCRIPTION OF THE PREFERRED EMBODIMENT OF THE INVENTION

Shown in FIG. 1 is a marine propulsion device 12 in the form of an outboard motor. Although the invention is disclosed in conjunction with an outboard motor, the invention can also be carried out in conjunction with a stern drive. The marine propulsion device 12 includes a transom bracket 14 fixedly mounted to a boat transom 16, and a swivel bracket 18 which is pivotally mounted on the transom bracket 14 for tilting movement about a generally horizontally extending tilt axis 20.

The marine propulsion device 12 also includes a propulsion unit 22 which is connected to the swivel bracket 18 for common movement therewith about the tilt axis 20 and for pivotal movement relative to the swivel bracket 18 about a generally vertical steering axis 24. The propulsion unit 22 comprises a power head 26, which includes an internal combustion engine 28, and a lower unit 30 including a drive shaft housing 32. The drive shaft housing 32 has an upper end 34 fixedly connected to the power head 26, and has a lower end 38. The lower unit 30 further includes a gear case 40 fixedly connected to the lower end 38 of the drive shaft housing 32. The lower unit 30 further includes a propeller shaft 42 supported by the gear case 40 for rotation relative thereto, and a propeller 44 carried by the propeller shaft 42. The propulsion unit 22 further comprises a vertically extending drive shaft 46 driven by the internal combustion engine 28. The propulsion unit 22 further comprises a reversing transmission 47 which is located in the gearcase 40 and which connects the drive shaft 46 to the propeller shaft 42. The internal combustion engine 28 drives the propeller shaft 42 through the drive shaft 46 and the reversing transmission 47.

Figure 2:
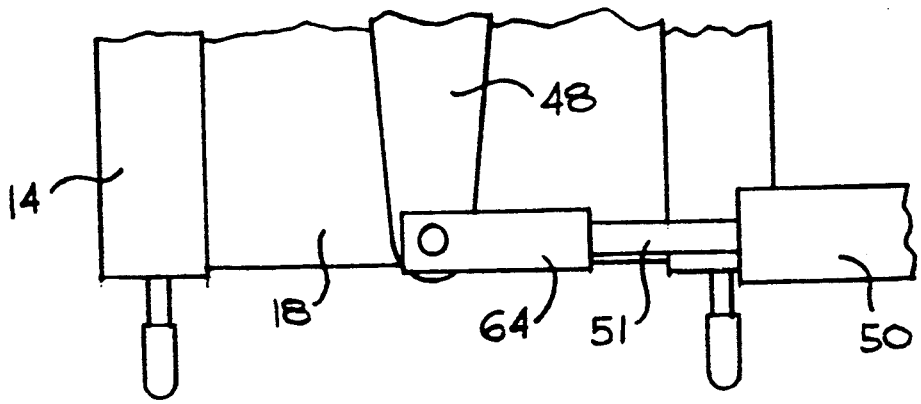
FIG. 2 is a partial plan view of the marine propulsion device.

The marine propulsion device 12 further includes a steering arm 48 fixed to the propulsion unit 22 and pivotal therewith about the steering axis 24. The marine propulsion device 12 also includes a user controllable steering mechanism 49 for pivoting the propulsion unit 22 about the steering axis 24. The steering mechanism 49 comprises (see FIG. 2) a cylinder 50 and a piston rod 51. A suitable steering system is described in Ferguson U.S. Pat. 4,710,141, which issued on Dec. 1, 1987, and which is incorporated herein by reference. During operation of the marine propulsion device 12, the propulsion unit 22 exerts on the piston rod 51, via the steering arm 48, a force (hereinafter "steering force") mainly as a result of rotation of the propeller 44 in the water.

The marine propulsion device 12 further includes (see FIG. 1) a hydraulic trim assembly 52 for selectively pivoting the swivel bracket 18 and the connected propulsion unit 22 about the horizontal tilt axis 20 and relative to the transom bracket 14. The hydraulic trim assembly 52 includes a hydraulic cylinder and piston assembly 53 connected between the transom bracket 14 and the swivel bracket 18, a reversible electric motor 54 (shown schematically in FIG. 3), and a hydraulic pump 55 (shown schematically in FIG. 3) driven by the electric motor and hydraulically connected to the cylinder and piston assembly 53. A suitable hydraulic trim assembly is disclosed in Burmeister et al U.S. Pat. 4,786,263, which issued on Nov. 22, 1988, and which is incorporated herein by reference.

The marine propulsion device 12 further includes manually operable means for actuating the hydraulic trim assembly 52. This manually operable means preferably includes a single double throw electrical switch or two momentary electrical switches 56 (shown schematically in FIG. 3) on the boat and accessible by an operator of the boat. Actuation of one of the momentary switches 56, or throwing of the single electrical switch in a first direction, causes the motor 54 to operate in a first direction, to cause extension of the hydraulic assembly 52, whereby the propeller 44 moves away from the transom 16 (i.e., the propulsion unit 22 is trimmed outwardly). Actuation of the other one of the momentary switches 56, or throwing of the single electrical switch in a second direction, causes the motor 54 to operate in a second direction opposite to the first direction, to cause contraction of the hydraulic assembly 52 whereby the propeller 44 moves toward the transom 16 (i.e., the propulsion unit 22 is trimmed inwardly). The switch or switches 56 operate through a microprocessor that will be described below.

The marine propulsion device 12 further comprises (see FIG. 3) a control system 60 for controlling trimming of the propulsion unit 22 in an effort to minimize steering force. The control system 60 includes a manually operable switch 61, such as a momentary switch, that when actuated provides an activation signal which is used in a manner described below for initiating automatic control of the trim of the propulsion unit 22. The control system 60 also includes means for sensing steering force. While various other means could be employed, in the illustrated embodiment, the means for sensing steering force includes (see FIG. 2) a load cell 64. The load cell 64 can be located wherever steering force can be measured. For example, the load cell 64 can be located on the steering arm, a drag link, or a steering cable of the marine propulsion device 12. In the illustrated embodiment, the load cell 64 is connected between the steering arm 48 and a portion of the steering mechanism 49 that is normally connected to the steering arm 48. More particularly, in the illustrated embodiment, the load cell 64 is connected between the steering arm 48 and the piston rod 51. The load cell 64 can be a strain gauge or a load transducer having a load to resistance element. The load cell 64 is preferably initially zeroed out (set to read zero steering force when there is no steering force). The load cell 64 is preferably able to sense both the magnitude and the direction of steering force.

The control system 60 further includes means for pivoting the propulsion unit 22 about the tilt axis 20 in response to the force sensed by the load cell 64. While various other means could be employed, in the illustrated embodiment, the means for pivoting the propulsion unit 22 about the tilt axis 20 includes the hydraulic assembly 52, motor control circuitry 65 connected to the motor 54, and a microprocessor 68 that communicates with the motor control circuitry 65 and that is programmed to automatically control trimming of the propulsion unit 22, via the motor control circuitry 65, inwardly and outwardly in a manner that will be described below. The motor control circuitry 65 acts as an interface between the microprocessor 68 and the motor 54 and includes, for example, relays or similar devices for converting low power signals from the microprocessor to higher power signals for energizing the motor 54. The means for pivoting the propulsion unit 22 about the tilt axis 20 further includes an analog to digital converter 72. The load cell 64 communicates to the microprocessor 68 via the analog to digital converter 72.

Figure 4:
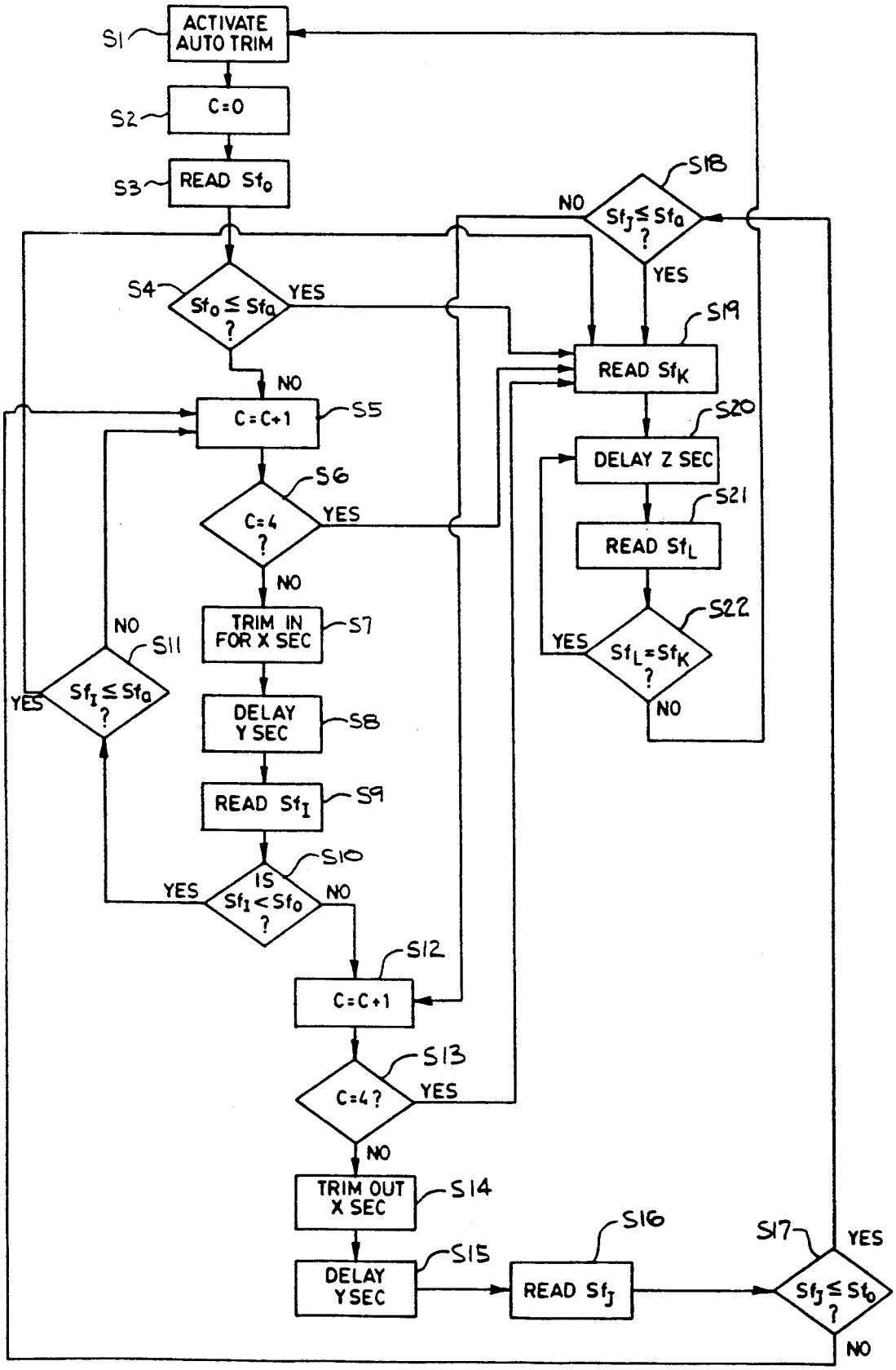
FIG. 4 is a logic diagram illustrating the logic utilized by the system of FIG. 3.

The microprocessor 68 is programmed to effect trimming of the propulsion unit 22 such that steering force is kept below a predetermined threshold or is minimized. FIG. 4 is a flowchart of one sequence of steps that can be programmed into the microprocessor 68 to achieve this result. Within the scope of the invention, any sequence of steps can be selected such that steering force is kept below a predetermined threshold or is minimized.

In the sequence of steps illustrated in FIG. 4, the microprocessor 68, at step S1, waits until an activation signal is received. An activation signal is provided when the switch 61 is actuated. The microprocessor 68 proceeds to step S2 after step S1 has been executed.

The microprocessor 68 includes a counter "C" which is initialized at step S2. In the illustrated embodiment, the counter is set to zero at step S2. The microprocessor 68 proceeds to step S3 after step S2 has been executed.

The microprocessor 68, at step S3, reads the magnitude of a steering force "$Sf_0$" sensed by the load cell 64. The microprocessor 68 proceeds to step S4 after step S3 has been executed.

The microprocessor 68, at step S4, determines if the steering force sensed at step S3 is less than or equal to a predetermined acceptable or threshold force "Sfa". If the steering force sensed at step S3 is less than or equal to the predetermined acceptable force, the microprocessor proceeds to step S19, which will be described below. If the steering force sensed at step S3 is greater than the predetermined acceptable force, the microprocessor proceeds to step S5.

The microprocessor 68, at step S5, increments the counter "C". The microprocessor 68 proceeds to step S6 after step S5 has been executed.

The microprocessor 68, at step S6, determines if the counter "C" has reached a predetermined maximum count value. In the illustrated embodiment, the predetermined maximum count value is four. If the counter has reached the predetermined maximum count value, the microprocessor proceeds to step S19, which will be described below. If the counter has not reached the predetermined maximum count value, the microprocessor proceeds to step S7.

The microprocessor 68, at step S7, effects trimming of the propulsion unit 22 in a first direction for a predetermined amount of time, e.g., "X" seconds. In the illustrated embodiment, the microprocessor 68, at step S7, trims the propulsion unit 22 inwardly. The microprocessor 68 proceeds to step S8 after step S7 has been executed.

The microprocessor 68, at step S8, waits or delays a predetermined amount of time, e.g., "Y" seconds. The microprocessor 68 proceeds to step S9 after step S8 has been executed.

The microprocessor 68, at step S9, reads the magnitude of a steering force "$Sf_I$" sensed by the load cell 64. The microprocessor 68 proceeds to step S10 after step S9 has been executed.

The microprocessor 68, at step S10, determines if the steering force sensed at step S9 is less than the force sensed at step S3. If the steering force sensed at step S9 is less than the force sensed at step S3, the microprocessor proceeds to step S11. If the steering force sensed at step S9 is greater than or equal to the force sensed at step S3, the microprocessor proceeds to step S12, which will be described below.

The microprocessor 68, at step S11, determines if the steering force sensed at step S9 is less than or equal to the predetermined acceptable force "Sa". If the steering force sensed at step S9 is less than or equal to the predetermined acceptable force, the microprocessor proceeds to step S19, which will be described below. If the steering force sensed at step S3 is greater than the predetermined acceptable force, the microprocessor proceeds to step S5.

The microprocessor 68, at step S12, increments the counter "C". The microprocessor 68 proceeds to step S13 after step S12 has been executed.

The microprocessor 68, at step S13, determines if the counter "C" has reached the predetermined maximum count value. If the counter has reached the predetermined maximum count value, the microprocessor proceeds to step S19, which will be described below. If the counter has not reached the predetermined maximum count value, the microprocessor proceeds to step S14.

The microprocessor 68, at step S14, effects trimming of the propulsion unit 22 in a second direction, opposite to the direction of trimming of step S7, for a predetermined amount of time, e.g., "X" seconds. In the illustrated embodiment, the microprocessor 68, at step S14, trims the propulsion unit 22 outwardly. The microprocessor 68 proceeds to step S15 after step S14 has been executed.

The microprocessor 68, at step S15, waits or delays a predetermined amount of time, e.g., "Y" seconds. The microprocessor 68 proceeds to step S16 after step S15 has been executed.

The microprocessor 68, at step S16, reads the magnitude of a steering force "$Sf_J$" sensed by the load cell 64. The microprocessor 68 proceeds to step S17 after step S16 has been executed.

The microprocessor 68, at step S17, determines if the steering force sensed at step S16 is less than or equal to the force sensed at step S3. If the steering force sensed at step S16 is less than or equal to the force sensed at step S3, the microprocessor proceeds to step S18. If the steering force sensed at step S16 is greater than the force sensed at step S3, the microprocessor proceeds to step S5.

The microprocessor 68, at step S18, determines if the steering force sensed at step S16 is less than or equal to the predetermined acceptable force "Sa". If the steering force sensed at step S16 is less than or equal to the predetermined acceptable force, the microprocessor proceeds to step S19. If the steering force sensed at step S16 is greater than the predetermined acceptable force, the microprocessor proceeds to step S12.

The microprocessor 68, at steps S19, S20, S21, and S22, performs a monitoring function in that the microprocessor samples steering force at regular intervals of time and provides an activation signal for restarting the sequence of steps following step S1 if steering force changes. In the illustrated embodiment, the microprocessor 68, at step S19, reads the magnitude of steering force "$Sf_K$" sensed by the load cell 64. The microprocessor 68 proceeds to step S20 after step S19 has been executed. The microprocessor 68, at step S20 waits or delays a predetermined amount of time, e.g., "Z" seconds. The microprocessor 68 proceeds to step S21 after step S20 has been executed The microprocessor 68, at step S21, reads the magnitude of a steering force "$Sf_L$" sensed by the load cell 64. The microprocessor 68 proceeds to step S22 after step S21 has been executed. The microprocessor 68, at step S22, determines if the steering force sensed at step S21 is equal to the force sensed at step S19. If the steering force sensed at step S21 is equal to the force sensed at step S19, the microprocessor proceeds to step S20. If the steering force sensed at step S21 is not equal to the force sensed at step S19, the microprocessor provides an activation signal for restarting the sequence of steps following step S1.

The microprocessor 68 is further programmed to terminate automatic control of the trimming of the propulsion unit 22, until the manually operable switch 61 for activating automatic control is actuated, if the switch (switches) 56 is (are) actuated.

In an optional embodiment of the invention, after the propulsion unit 22 has been trimmed in one direction, the microprocessor 68 will sense a steering force, and will compare the sensed steering force with the immediately preceding sensed steering force, and the microprocessor 68 will again trim the propulsion unit in the one direction only if the sensed steering force is less than the immediately preceding sensed steering force. Otherwise, the microprocessor will trim the propulsion unit in a second direction opposite to the first direction by a distance less than or equal to the distance the propulsion unit was last trimmed in the first direction, and the microprocessor will then proceed to step S19.

In an optional embodiment of the invention, the microprocessor 68 utilizes the sensed direction of the steering force to determine whether to trim the propulsion unit 22 inwardly or outwardly.

In an optional embodiment of the invention different from the embodiment described in the immediately preceding paragraph, if the counter has only been incremented one time in step S5, if in step S10 it is determined that the steering force sensed after trimming the propulsion unit in a first direction is not less than the steering force sensed in step S3, and if the counter has not yet reached the predetermined maximum count value, then the microprocessor will effect trimming of the propulsion unit in a second direction opposite to the first direction by a distance greater than (e.g. twice) the distance that the propulsion unit was trimmed in the first direction. Thereafter, the microprocessor effects trimming in the second direction by a distance that is approximately equal to the distance that the propulsion unit was trimmed in the first direction, at least until after steps S19, S20, S21, and S22 have been performed.

Figure 3:
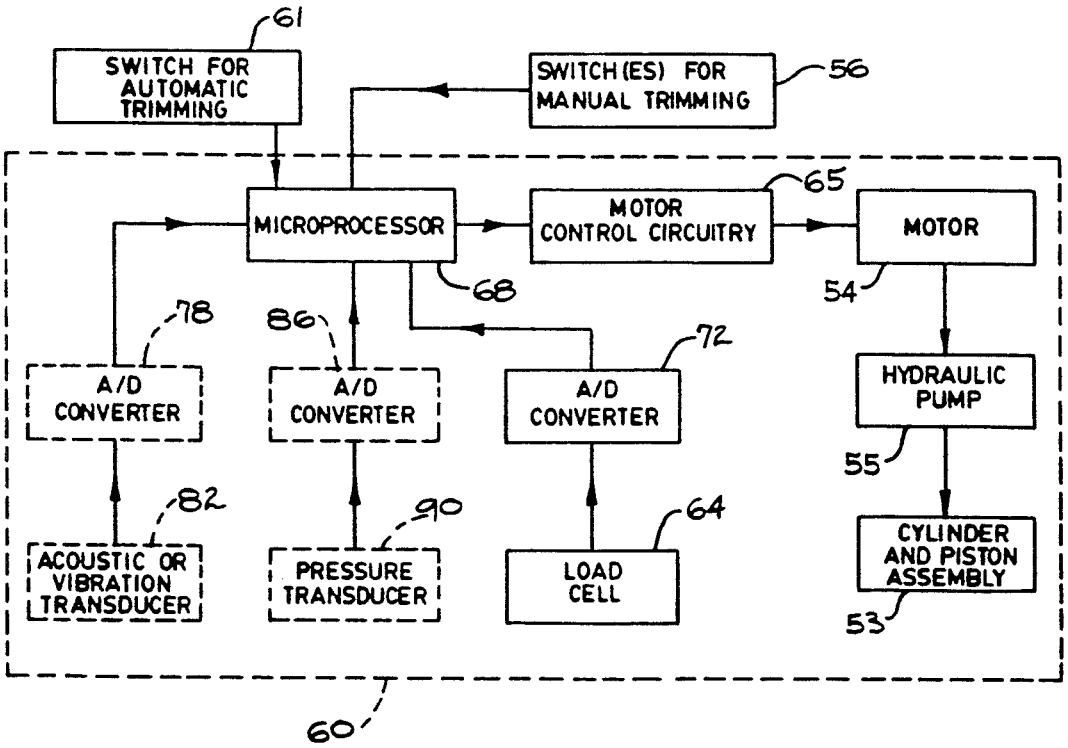
FIG. 3 is a block diagram of a system included in the marine propulsion device and for counterbalancing steering force.

Optionally, as shown in FIG. 3, the control system 60 further includes an analog to digital converter 78, and an acoustic or vibration transducer 82 that is located proximate the propeller 44 and that communicates to the microprocessor 68 via the analog to digital converter 78. In this optional embodiment, the microprocessor 68 functions to adjust the trim of the propulsion unit 22 by analyzing sound detected by the acoustic or vibration transducer 82 and emanating from proximate the propeller 44. The microprocessor 68 maintains the trim of the propulsion unit 22 so as to avoid ventilation of the propeller. Propeller ventilation is a normally undesirable condition in which air above the water in which the boat is travelling is drawn into contact with the propeller. Propeller ventilation can result in a loss of boat speed, unnecessarily high engine rpm, cavitation of the propeller, and increased noise and vibration. Propeller ventilation is typically caused by a trim of the propulsion unit that is too high, or from sharp turning of the boat tending to move the propeller closer to the surface of the water on which the boat rides. The microprocessor 68, in this optional construction, utilizes signature analysis of the sound detected by the acoustic or vibration transducer 82 to detect propeller ventilation, and to adjust the trim of the propulsion unit 22 if propeller ventilation is detected, even if the steering force is below the predetermined acceptable value. Signature analysis involves an examination of sound or vibration waves to detect a certain condition. In this case, the certain condition detected by the signature analysis is propeller ventilation. The microprocessor 68 optionally further utilizes this signature analysis to maximize boat speed by, at regular intervals or upon actuation of a user operable actuator, adjusting the trim of the propulsion unit so that propeller ventilation is just barely avoided. As reducing steering force is more important than maximizing boat speed, the microprocessor 68 is programmed to give precedence to maintaining steering force at or below the predetermined acceptable value. Thus, in this optional embodiment, the trim of the propulsion unit is adjusted so that maximum boat speed is achieved as long as steering force is kept at or below a predetermined acceptable value. In this optional embodiment, a hydraulic steering system could be included in the marine propulsion device 12 so that the predetermined acceptable value of steering force can be higher and the operator of the boat will be assisted in compensating for the steering force.

Optionally, the control system 60 includes an analog to digital converter 86, and a speed detecting pressure transducer 90, such as in Olson et al. U.S. Pat. 4,718,872 (which is incorporated herein by reference), instead of the analog to digital converter 78 and the acoustic or vibration transducer 82. In this optional embodiment, the pressure transducer 90 communicates to the microprocessor 68 via the analog to digital converter 86. As is the case in the construction disclosed in Olson et al. U.S. Pat. 4,718,872, the trim of the propulsion unit 22 is adjusted to maximize the speed sensed by the detecting pressure transducer 90. As reducing steering force is more important than maximizing boat speed, in this optional embodiment, the microprocessor 68 is programmed to give precedence to maintaining steering force at or below the predetermined acceptable value. Thus, in this optional embodiment, the trim of the propulsion unit is adjusted in the manner described in Olson et al. U.S. Pat. 4,718,872 so that maximum boat speed is achieved as long as steering force is kept at or below a predetermined acceptable value. In this optional embodiment, hydraulic steering could be employed so that the predetermined acceptable value of steering force can be higher and the operator of the boat will be assisted in compensating for the steering force.

In one optional embodiment of the invention, the control system 60 includes all of the analog to digital converters 78, 86, and 72 described above, and includes the acoustic or vibration transducer 82, the pressure transducer 90, and the load cell 64 described above. In this optional embodiment of the invention, the microprocessor 68 adjusts the trim of the propulsion unit 22 in response to the acoustic or vibration transducer 82, the pressure transducer 90, and the load cell 64.

Various of the features of the invention are set forth in the following claims.

I claim:

1. A marine propulsion device comprising a propulsion unit adapted to be mounted to a boat for pivotal movement about a generally horizontal tilt axis, and for pivotal movement about a generally vertical steering axis, said propulsion unit including a propeller shaft adapted to support a propeller for rotation therewith, said marine propulsion device further comprising a steering mechanism for pivoting said propulsion unit about the steering axis, and a control system including means for sensing force applied on said steering mechanism by said propulsion unit, and means for pivoting said propulsion unit about the tilt axis in response to the force sensed by said force sensing means.

2. A marine propulsion device in accordance with claim 1 wherein said control system includes means for pivoting said propulsion unit about the tilt axis, from a first position, in a first angular direction to a second position, and wherein said control system also includes means for determining if the force on said steering mechanism decreases in response to movement of said propulsion unit from the first position to the second position.

3. A marine propulsion device in accordance with claim 2 wherein said control system also includes means for pivoting said propulsion unit about the tilt axis in a second angular direction opposite to the first angular direction, from the second position to a third position, if the force on said steering mechanism does not decrease in response to movement of said propulsion unit from the first position to the second position.

4. A marine propulsion device in accordance with claim 3 wherein said control system further includes means for pivoting said propulsion unit about the tilt axis in the second angular direction from the third position if the force on said steering mechanism is not greater when said propulsion unit is in the third position than when said propulsion unit is in the first position.

5. A marine propulsion device in accordance with claim 4 wherein the third position is angularly equivalent to the first position with respect to the tilt axis.

6. A marine propulsion device in accordance with claim 4 wherein said control system also includes means for pivoting said propulsion unit about the tilt axis in the second angular direction from the third position, through consecutive positions, while the force on said steering mechanism is not greater than when said propulsion unit is in the first position and while the force on said steering mechanism is above a predetermined value.

7. A marine propulsion device in accordance with claim 6 wherein said control system ceases pivoting said propulsion unit if the force on said steering mechanism remains above the predetermined value after said propulsion unit has been pivoted through a predetermined number of positions.

8. A marine propulsion device in accordance with claim 2 wherein said control system also includes means for pivoting said propulsion unit about the tilt axis in the first angular direction from the second position if the force on said steering mechanism decreases in response to movement of said propulsion unit from the first position to the second position and the force on said steering mechanism is above a predetermined value when said propulsion unit is in the second position.

9. A marine propulsion device in accordance with claim 2 wherein said control system also includes means for pivoting said propulsion unit about the tilt axis in the first angular direction from the second position, through consecutive positions, while the force on said steering mechanism is less than when said propulsion unit is in the first position and while the force on said steering mechanism is above a predetermined value.

10. A marine propulsion device in accordance with claim 9 wherein said control system ceases pivoting said propulsion unit if the force on said steering mechanism remains above the predetermined value after said propulsion unit has been pivoted through a predetermined number of positions.

11. A marine propulsion device in accordance with claim 1 wherein said control system effects pivotal movement of said propulsion unit only if the force sensed by said sensing means exceeds a predetermined value.

12. A marine propulsion device in accordance with claim 1 wherein said control system also includes means for detecting an acoustic vibration, and wherein said control system effects pivotal movement of said propulsion unit further in response to said acoustic vibration detecting means.

13. A marine propulsion device in accordance with claim 1 wherein said control system also includes means for sensing boat speed, and wherein said pivotal movement effecting means is further responsive to said speed sensing means.

14. A method of monitoring force on a steering mechanism of a marine propulsion device including a propulsion unit adapted to be mounted on the transom of a boat for pivotal movement about a generally horizontal tilt axis and for pivotal movement about a generally vertical steering axis, the steering mechanism effecting pivotal movement of the propulsion unit about the generally vertical steering axis, said method comprising the steps of measuring the force applied to the steering mechanism by the propulsion unit, and pivoting the propulsion unit about the tilt axis in response to the measured force.

15. A method in accordance with claim 14 wherein said pivoting is performed automatically.

16. A method in accordance with claim 14 wherein said measuring and pivoting steps comprise the following steps in order: pivoting the propulsion unit about the tilt axis, from a first position, in a first angular direction, to a second position, and determining if the force on the steering mechanism decreases in response to movement of the propulsion unit from the first position to the second position.

17. A method in accordance with claim 16 wherein said measuring and pivoting steps further comprise, after said step of determining if the force on the steering mechanism decreases in response to movement of the propulsion unit from the first position to the second position, the step of pivoting the propulsion unit about the tilt axis in a second direction opposite to the first direction, from the second position to a third position, if the force on the steering mechanism does not decrease in response to movement of the propulsion unit from the first position to the second position, and the step of pivoting the propulsion unit about the tilt axis in the first angular direction from the second position if the force on the steering mechanism decreases in response to movement of the propulsion unit from the first position to the second position and the force on the steering mechanism is above a predetermined value when the propulsion unit is in the second position.

18. A method in accordance with claim 17 and further comprising the step of pivoting the propulsion unit about the tilt axis in the first angular direction from the second position, through consecutive positions, while the force on the steering mechanism is less than when the propulsion unit is in the first position and while the force on the steering mechanism is above a predetermined value, and the step of pivoting the propulsion unit about the tilt axis in the second angular direction from the third position, through consecutive positions, while the force on the steering mechanism is not greater than when the propulsion unit is in the first position and while the force on the steering mechanism is above the predetermined value.

19. A method of monitoring force on a steering mechanism of a marine propulsion device including a propulsion unit adapted to be mounted on the transom of a boat for pivotal movement about a generally horizontal tilt axis and for pivotal movement about a generally vertical steering axis, the steering mechanism effecting pivotal movement of the propulsion unit about the generally vertical steering axis, said method comprising the following steps:

(a) providing a counter, and means for generating an activation signal;

(b) initializing the counter only in response to the activation signal, then proceeding to step (c) after initializing the counter;

(c) measuring the force applied to the steering mechanism by the propulsion unit, then proceeding to step (d);

(d) determining if the force measured in step (c) is greater than a predetermined acceptable force value,
and if so, proceeding to step (e),
and if not, proceeding to step (b);

(e) incrementing the counter, then proceeding to step (f);

(f) determining if the counter is in excess of a predetermined value,
and if so, proceeding to step (b),
and if not, proceeding to step (g);

(g) causing the propulsion unit to pivot about the tilt axis in a first angular direction for a predetermined amount of time, then proceeding to step (h);

(h) waiting for a predetermined amount of time, then proceeding to step (i);

(i) measuring the force applied to the steering mechanism by the propulsion unit, then proceeding to step (j);

(j) determining if the force measured in step (i) is less than the force measured in step (c),
and if so, proceeding to step (k),
and if not, proceeding to step (l);

(k) determining if the force measured in step (i) is greater than said predetermined acceptable force value,
and if so, proceeding to step (e),
and if not, proceeding to step (b);

(l) incrementing the counter, then proceeding to step (m);

(m) determining if the counter is in excess of the predetermined value,
and if so, proceeding to step (b),
and if not, proceeding to step (n);

(n) causing the propulsion unit to pivot about the tilt axis in second angular direction opposite to the first angular direction and for a predetermined amount of time, then proceeding to step (o);

(o) waiting for a predetermined amount of time before proceeding to step (p);

(p) measuring the force applied to the steering mechanism;

(q) determining if the force measured in step (p) is greater than the force measured in step (c),
and if so, proceeding to step (e),
and if not, proceeding to step (r);

(r) determining if the force measured in step (p) is greater than said predetermined acceptable force value,
and if so, proceeding to step (l),
and if not, proceeding to step (b).

20. A marine propulsion device in accordance with claim 1 wherein said sensing means is connected between said steering mechanism and said propulsion unit.

* * * * *